United States Patent [19]

Graven et al.

[11] 4,226,701

[45] * Oct. 7, 1980

[54] TEMPORARY SHUTDOWN OF CO-COMBUSTION DEVICES

[75] Inventors: Richard G. Graven, Westmont; Robert A. Sailor, Cinnaminson, both of N.J.

[73] Assignee: Mobil Oil Corporation, New York, N.Y.

[ * ] Notice: The portion of the term of this patent subsequent to Dec. 20, 1994, has been disclaimed.

[21] Appl. No.: 1,648

[22] Filed: Jan. 8, 1979

Related U.S. Application Data

[62] Division of Ser. No. 832,140, Sep. 12, 1977, Pat. No. 4,146,464, which is a division of Ser. No. 703,862, Jul. 9, 1976, Pat. No. 4,064,047.

[51] Int. Cl.[2] ..... C10G 11/04; B01J 8/24

[52] U.S. Cl. ..... 208/121; 208/113; 208/164; 252/417

[58] Field of Search ..... 208/121; 252/417

[56] References Cited

U.S. PATENT DOCUMENTS

| | | | |
|---|---|---|---|
| 3,849,291 | 11/1974 | Owen et al. | 208/78 |
| 4,006,075 | 2/1977 | Luckenbach | 208/164 |
| 4,064,037 | 12/1977 | Graven et al. | 208/120 |
| 4,064,039 | 12/1977 | Penick | 208/160 |
| 4,072,600 | 2/1978 | Schwartz | 208/120 |
| 4,108,795 | 8/1978 | Hemler et al. | 208/120 X |
| 4,118,339 | 10/1978 | Latos | 252/417 |
| 4,146,464 | 3/1979 | Graven et al. | 208/120 |
| 4,148,751 | 4/1979 | Hemler et al. | 208/120 X |
| 4,152,292 | 5/1979 | Conner et al. | 252/417 |

FOREIGN PATENT DOCUMENTS

| | | | |
|---|---|---|---|
| 2507343 | 9/1975 | Fed. Rep. of Germany | 208/120 |

*Primary Examiner*—Delbert E. Gantz
*Assistant Examiner*—G. E. Schmitkons
*Attorney, Agent, or Firm*—Charles A. Huggett; Vincent J. Frilette

[57] ABSTRACT

A metal combustion promoter is introduced into the circulating inventory of catalyst in the catalytic cracking process to temporarily change the operating mode of the regenerator and decrease the CO content of the flue gas, thus permitting temporary shutdown of the CO-boiler of CO-incinerator, while continuing operation of the catalytic cracking process. The metal combustion promoters are compounds of platinum, iridium, osmium, palladium, rhodium, ruthenium, or rhenium. The described technique permits rapid shutdown and minimizes the time of operation outside of compliance with local or other ordinances.

2 Claims, 1 Drawing Figure

TEMPORARY SHUTDOWN OF CO-COMBUSTION DEVICES

CROSS REFERENCES TO RELATED APPLICATIONS

This application is a division of application Ser. No. 832,140 filed Sept. 12, 1977, now U.S. Pat. No. 4,146,464; which is a division of application Ser. No. 703,862, filed July 9, 1976, now U.S. Pat. No. 4,064,047.

BACKGROUND OF THE INVENTION

1. Field of the Invention

This invention is concerned with temporary shutdown of CO-combustion devices fed with flue gas produced in the catalytic cracking of petroleum hydrocarbons. In particular, it is concerned with temporary shutdown of CO-boilers and CO-incinerators in petroleum refineries.

2. Description of the Prior Art

Catalytic cracking of petroleum fractions is a well-established refinery process. The catalytic cracking apparatus per se comprises a reactor section that contains a reaction zone where fresh feed is mixed with hot regenerated catalyst under cracking conditions to form cracked products and deactivated, coked catalyst; and a regenerator section that contains a regeneration zone where the coked catalyst, after separation from volatile hydrocarbons, is burned by contact with air to form regenerated catalyst. Moving catalyst bed and fluidized bed versions of this process are used. Regardless of the design of the catalytic cracking apparatus, all present-day plants operate with a catalyst inventory that continuously circulates between the reactor section and the regenerator section. The two sections are connected by conduits through which circulation is maintained.

It is common practice to operate the regenerator with a limited amount of air feed so that the gaseous combustion products contain less than about 0.2 volume percent oxygen. Under such conditions, substantial concentrations of carbon monoxide (CO) are contained in the flue gas exiting from the regenerator. The actual concentration of carbon monoxide in the flue gas may vary depending on the particular plant, the nature of the catalyst and the detailed operation of the regenerator, but usually it remains in the range of about 4 to about 9 volume percent. The volume ratio of carbon dioxide to carbon monoxide (i.e. $CO_2/CO$ ratio) normally varies from about 0.7 to about 3, and is a measure of the completeness of combustion of the reacted carbon in the coke. Thus, in operating with a limited amount of air, only about three-fourths of the total potential heat of combustion of coke is released in the regenerator itself.

Many refineries continuously feed the flue gas to a CO-boiler to complete the conversion of CO to $CO_2$, and thus generate substantial quantities of process steam for use in the cracking process or elsewhere in the refinery. In general, the CO boilers used differ in design from refinery to refinery, but they are generally utility boilers of the tube type. In operation, the flue gas is enriched with air and burned in the furnace of the boiler. The boiler ordinarily is equipped to accept at least one other fuel, which is used in start-up, or to supplement the fuel value of the flue gas, or to provide process steam when the catalytic cracking apparatus itself is shut down. Because of the nature of the service, the operation of the CO-boiler is subject to temporary shutdown for maintenance and repair. During these periods of shutdown, there is usually no other available means to reduce the CO content of the flue gas from the regenerator of the catalytic cracking process. In many communities this creates a serious problem because of antipollution regulations. Depending on circumstances, the catalytic cracking apparatus itself may have to be shut down, or permission of the civil authorities may be required to operate temporarily out of compliance with the ordinances.

In some refineries, the flue gas is passed to a carbon monoxide incinerator (CO-incinerator) where the CO is burned to $CO_2$. Here again, temporary shutdown of the incinerator for maintenance or repair creates a problem in the disposal of the flue gas, which may in some cases be resolved only by also shutting down the catalytic cracking operation itself. Such shutdown is complex and costly.

For convenience, the term "CO-combustion device" will be used in this specification, including claims, to refer to either a CO-boiler or a CO-incinerator, since both of these units serve to combust CO to $CO_2$.

It has been known for some time that cracking catalysts may be modified by the addition of metal combustion promoters to increase the $CO_2/CO$ ratio, and thus the combustion efficiency in the regenerator. The use of chromium as a promoter for moving-bed type catalytic cracking catalysts is one such example, more fully described in U.S. Pat. No. 2,647,860. In fact, a number of other metals, including nickel, deposited from the feedstock of the cracking process, are also believed to effect some degree of change in the combustion efficiency. Up until recently, however, most of the known metals had the serious drawback that, when included in the cracking catalyst in sufficient quantity to substantially affect the combustion efficiency, they also had a substantial detrimental effect on the cracking selectivity. It is well recognized, for example, that more than extremely small trace amounts of nickel in the feedstock to the cracking unit cause excessive production of coke and dry gas.

It has recently been discovered that very substantial effect on the combustion efficiency can be achieved, with little or no effect, or even an advantage, in the cracking operation, if certain Group VIII metals, more fully described hereinafter, are added to the cracking catalyst. In fact, the operation of the regenerator can be changed from partial combustion of carbon to substantially complete combustion if the cracking catalyst is promoted with as little as 2 ppm of platinum, for example. This development is more fully described in copending U.S. application Ser. No. 649,261 filed Jan. 15, 1976 (now U.S. Pat. No. 4,072,600), the entire contents of which are incorporated herein by reference.

As described therein, the metal combustion promoter may be deposited on the cracking catalyst during operation of the catalytic cracking process by introducing a suitable compound of the metal into the hydrocarbon feed to the cracking zone. This method of depositing the combustion promoter on the cracking catalyst has the particular advantage that it can be done rapidly, and thus rapidly affect the combustion efficiency during burnoff of coke deposits in the regenerator.

SUMMARY OF THE INVENTION

By the method of this invention, a CO-combustion device, fed with the flue gas continuously discharged from the regenerator of a catalytic cracking unit, is temporarily shut down while continuihg operation of the cracking unit, yet without discharging large amounts of carbon monoxide to the atmosphere. This is accomplished by introducing a trace amount of metal combustion promoter into the cracking catalyst circulating in the cracking unit, and increasing the air flow rate to the regenerator. This combination of steps, more fully described hereinbelow, effects combustion of unburned CO in the regenerator of the catalytic cracking unit, and the flue gas, substantially free of CO, is discharged to the atmosphere. The CO-combustion device is now temporarily out of its intended service, and may be repaired or serviced as required. Upon completion of repairs, the former mode of operation is restored rapidly by restricting the air feed to the regenerator, whereupon the CO content of the flue gas is increased to about its former value and consumed in the CO-combustion device.

DESCRIPTION OF PREFERRED EMBODIMENTS

Figure 1:
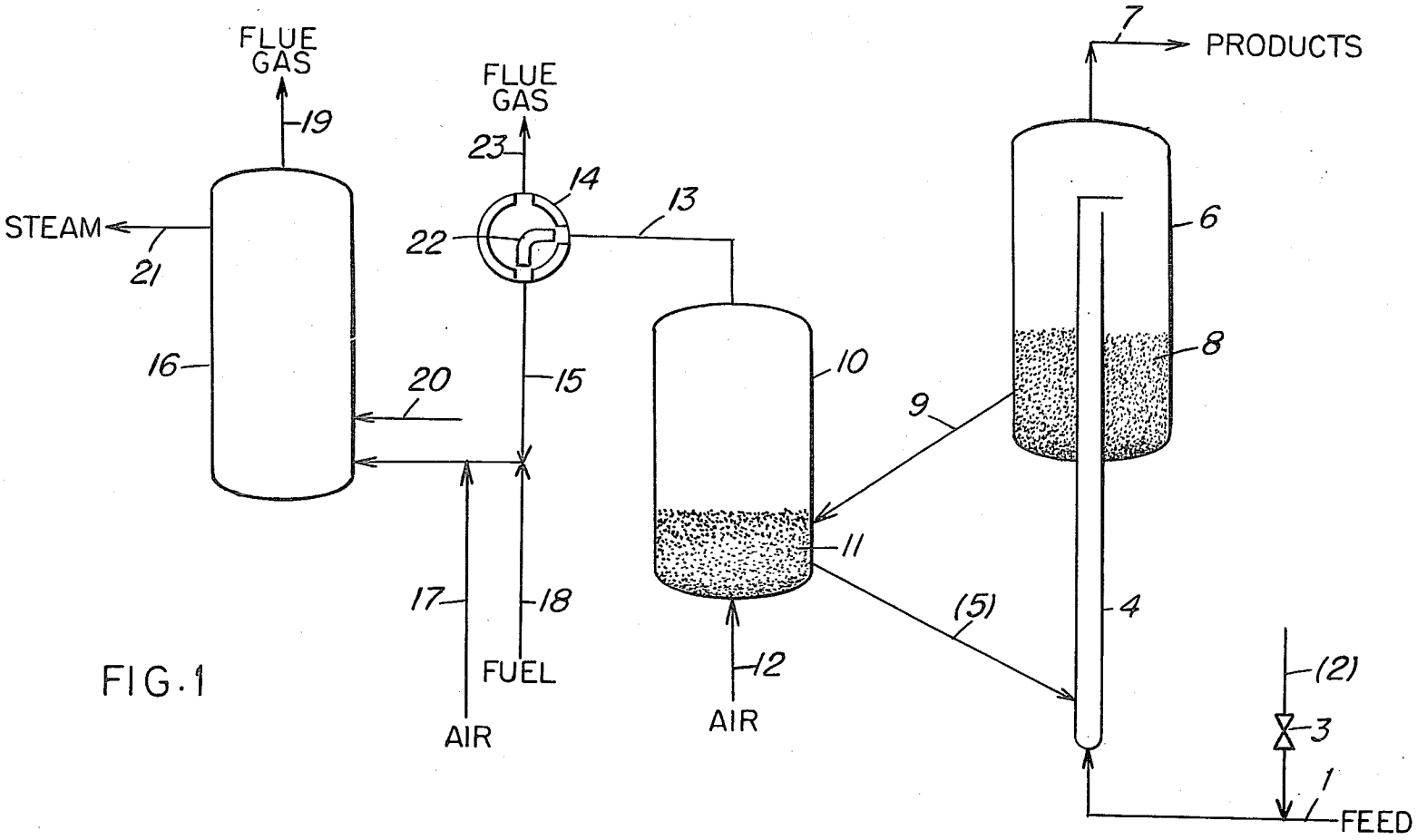
FIG. 1 is a simplified flow sheet of a catalytic cracking apparatus and a CO-boiler.

The invention will now be illustrated by reference to FIG. 1.

Feed hydrocarbon is passed via conduit (1) to the cracking section of the cracking apparatus illustrated in the drawing by a riser cracker. The feed may be preheated by preheating means (not shown). Conduit (1) is provided with conduit means (2) and valve means (3) for the controlled introduction of a metal combustion promoter. In ordinary operation, i.e. with the CO-boiler on stream, valve means (3) is closed. The hydrocarbon feed enters the riser (4) where it is mixed with hot regenerated catalyst passed by conduit means (5), and the mixture is cracked in the absence of added hydrogen, and passes into vessel (6) where it is separated, by separating means (not shown), into hydrocarbon products and coked catalyst. The hydrocarbon products are removed from vessel (6) via line (7). The spent, coked catalyst settles and forms a dense fluidized bed (8) contained within vessel (6). Spent catalyst continuously passes via spent catalyst transfer conduit via (9) to regenerator vessel (10) where it forms a dense fluidized bed (11). In normal operation, catalyst particles are carried into the space above dense fluidized bed (11) to form a dilute fluidized phase (not shown). Separator means such as cyclones within regenerator (10) insure return of catalyst particles to dense fluidized bed (11). As used herein, the term "regeneration zone" is meant to include both dense fluidized bed (11) and the dilute phase above it, as well as any other regions in the regenerator (10) wherein combustion occurs.

Air is introduced into the regenerator (10) via conduit (12) to combust the coke deposits, and the resulting flue gas leaves vessel (10) via line (13) and is passed to valve means (14). In ordinary operation, valve means (14) passes the flue gas to CO-boiler (16) via internal valve passage (22) and conduit (15). Air ordinarily introduced into and mixed with the flue gas stream is provided via conduit (17). Additional fuel may continuously or intermittently be introduced into the CO-boiler via conduit (18). Combustion products of the flue gas and the additional fuel that may be burned, said combustion products now substantially free of carbon monoxide, are vented via flue (19). In normal operation, water is passed to the CO-boiler via line (20) and exits as process steam via line (21).

To practice this invention, when it is desired to temporarily discontinue operation of CO-boiler (16), valve (3) is opened and a metal combustion promoter is introduced into the hydrocarbon liquid feed conduit, where it mixes with the feed and is carried to the catalyst in riser (4). Suitable metal combustion promoter compounds and the quantities required will be described hereinafter. The cracking catalyst, modified by the presence of combustion promoter deposited thereon, passes to the regenerator (10) and is cycled between the regenerator and the reactor as before. When adequate combustion promoter is present in the system, the quantity of air passed to regenerator (10) via conduit (12) is increased to change the operating mode of the regenerator from partial combustion of carbon to substantially complete combustion. With complete combustion achieved, valve means (14) is adjusted by switching internal valve passage (22) so that the flue gas is passing from regenerator (10) via line (13) is diverted to the flue stack (23). To restore normal operation, the amount of air passed via conduit (12) is decreased to change the operating mode from substantially complete carbon combustion to partial combustion of carbon, and valve means (14) is adjusted to divert the flue gas in line (13) back to the CO-boiler.

Although the practice of this invention is illustrated in FIG. 1 with a CO-boiler as the carbon monoxide combustion device, its utility encompasses CO-combustion devices generally, and CO-incinerators in particular. The term "temporary" as used herein is essentially self-explanatory. The time ordinarily required to repair or service the CO-combustion device and restore it to normal sevice is intended. Contemplated periods of time range from several hours to several weeks, usually less than about one month. In addition to repair or service of a CO-combustion device, this invention may advantageously be practised for temporary shutdown in situations where the steam from a CO-boiler cannot profitably be used, say for a period of from several hours to a month. Such a situation could arise from shortage of feedstock for the unit receiving the supply of steam, for example. Thus, the term "temporary" as used herein is clearly concerned with situations where there is intent to restore a CO-combustion device to normal service, and where such restored service in fact occurs.

Although the illustration of FIG. 1 is for a fluid catalyst cracking process in which the catalyst particles are from about 10 microns to about 90 microns in size, it is equally appicable to a moving bed catalytic system, illustrated by the Thermafor Catalytic Cracking process which uses catalyst cracking particles of about 6.5 millimeters diameter in a non-fluidized state. Also, although the illustration of FIG. 1 shows a riser cracker configuration for the reaction section, this invention is equally applicable to other fluidized catalytic cracking reactor designs and to regenerator designs other than illustrated. In other words, this invention is broadly applicable to any catalytic hydrocarbon cracking process that utilizes a circulating inventory of catalyst, such an inventory being represented in FIG. 1 by the catalyst contained in dense fluid beds (8) and (11) plus the catalytic material present in the transfer conduits (4), (5), and (9). It is very much preferred, however, to practice this invention with a fluid catalytic cracking process which operates in the absence of added hydrogen.

The metal combustion promoter compounds that are used in the practice of this invention include compounds of any of the metals selected from the 5th and 6th periods of Group VIII of the periodic table and rhenium. Of these metals, platinum, palladium and rhenium are preferred. Platinum is particularly preferred. The metal is introduced into the cracking apparatus preferably in the form of a compound that is sufficiently stable to permit transport to the catalyst before substantial decomposition sets in. The particular compounds that are useful will depend to some extent on where in the catalytic cracking apparatus it is decided to introduce the metal compound. The compound may be introduced into the regenerator, for example, with the air stream provided for the combustion, or even through a steam line. The catalytic apparatus generally includes a section or provision for exposing the spent catalyst to steam prior to entrance to the regenerator. This is generally known in the art as a "stripper"; the volatile metal promoter compound may be added to steam feed to the stripper to cause deposition on the catalyst prior to its entrance into the regenerator. Alternately, a volatile metal compound may be added to the process steam feed to the riser of the cracking apparatus. It is a preferred mode of operation however to introduce the metal combustion promoter into the hydrocarbon feedstock, such as a gas oil charge stock, for incorporation in the catalyst as the charge is cracked. Such compounds include metal diketonates, carbonyls, metallocenes, olefin complexes of 2 to 20 carbons, acetylene complexes, alkyl or aryl phosphine complexes and carboxylates of 1 to 20 carbons. Specific examples of these are platinum acetylacetonate, tris(acetylacetonato)rhodium(III), triiodoiridium(III) tricarbonyl, $\pi$-cyclopentadienylrhenium(I) tricarbonyl, ruthenocene, $\pi$-cyclopentadienylosmium(I) dicarbonyl dimer, dichloro(ethylene)palladium(II) dimer, ($\pi$-cyclopentadienyl) (ethylene)rhodium(I), diphenylacetylenebis(triphenylphosphino)platinum(O), bromomethylbis(triethylphosphino)palladium(II), tetrakis(triphenylphosphino)palladium(O), chlorocarbonylbis(triphenylphosphino)iridium(I), palladium acetate, and palladium naphthenate.

The exact amount of metal to be deposited on the circulating inventory of the catalyst depends on the particular catalytic cracking apparatus used and on its particular manner of operation. In general, the total amount of metal introduced does not exceed 5 ppm, (i.e. parts of metal per million parts of cracking catalyst) and generally amounts in the range of 0.5 to 5 ppm are found to be effective. In the preferred mode of practice of this invention, the $CO_2/CO$ ratio in the flue gas is monitored while injecting the metal compound, and the injection is terminated when the $CO_2/CO$ ratio is at least about 15. The ratio 15 corresponds usually to a concentration of CO in the hot flue gas of about 1 volume percent, which is tolerable in many instances for direct discharge to the atmosphere. Where local ordinances are stringent, however, it is preferred to inject sufficient metal compound to reduce the CO content of the flue gas discharged from the regeneration zone to less than about 0.2 volume percent, i.e. less than about 2000 ppm.

It is a particular feature of this invention that the effect of the metal promoter is observable within a very short time after its introduction; thus the deposition of the metal promoter may be made rapidly, over a period of several hours, for example, thus permitting relatively rapid shutdown of the CO boiler and diversion of the flue gas directly to the atmosphere. During the period of repair or service of the flue boiler, it is desirable to monitor the $CO_2/CO$ and to make further small addition of the metal promoter should this ratio fall below the desired limit. It should be understood, of course, that along with the original introduction of the metal promoter, it is necessary also to increase the air flow rate to the regenerator to provide sufficient oxygen to support the more efficient combustion. However, the steps of introducing the metal combustion promoter and increasing the air feed rate to the regenerator need not be done simultaneously. In fact, it is preferred to build up the trace concentration of promoter about to the level at which it is effective to induce the required additional combustion prior to increasing the air rate since proceeding in reverse order may cause undesirable afterburning of the unreacted carbon monoxide and excessively high temperatures in the regenerator dilute phase zone, cyclones or flue gas line.

The initiation of CO combustion in the regenerator depends on a number of interacting factors. The availability of sufficient oxygen is of course obvious. Another important factor is the temperature of the dense bed in the regenerator. In general, the present invention requires a minimum dense bed temperature of about 1,000° F. It is preferred to operate at a temperature of at least 1050° F. In general, the lower the temperature of the dense bed the more metal combustion promoting catalyst is required to change the $CO_2$ to CO ratio significantly. Once the burning of CO is initiated, the temperature of the dense bed will of course tend to rise and, depending on the particular feedstock and other parameters of the system the temperature rise may be sufficient to cause damage to the reactor wall or other metal parts of the equipment or even to the catalyst itself. However, as known to those skilled in the art, this temperature rise may be counteracted by decreasing or eliminating the oil feed pre-heat or air feed pre-heat, or both, or by other changes such as a change in the oil feed rate.

On achieving the desired $CO_2/CO$ ratio, the hot flue gas from the regenerator may be passed through a heat exchanger to recover sensible heat prior to passage to the atmosphere.

On completion of servicing of the CO-combustion device, the air to the regenerator is reduced in flow rate, thereby reducing the $CO_2/CO$ ratio to about its former range of about 0.7 to 3, and the high concentration of carbon monoxide is again burned in the usual manner, thus restoring service.

The activity of the metal combustion promoter decays over a relatively short period of time, the rate of decay depending on the metal itself and the environment in the cracking apparatus. Thus, should it become necessary to repeat the shutdown method of this invention, this may be done by repetition of the described procedure, including introducing a trace amount of metal combustion promoter into the circulating inventory of cracking catalyst, as described hereinabove.

We claim:

1. A method for initiating the combustion of excess CO in the regenerator of a Fluid Catalytic Cracking Unit, said regenerator being operated with insufficient air flow rate to support said combustion, which method comprises:

building up the trace concentration of a metal combustion promoter selected from compounds of platinum, iridium, osmium, palladium, rhodium, ruthenium, or rhenium in the catalyst inventory of said unit to a level which is effective to induce the combustion of CO;

adjusting the temperature of the dense bed of the regenerator to a minimum of 1000° F.; and subsequently increasing the air flow rate to the regenerator to provide sufficient oxygen to support said combustion.

2. The method described in claim 1 wherein said combustion promoter metal comprises platinum.

* * * * *